US007036435B2

(12) United States Patent
Morand et al.

(10) Patent No.: US 7,036,435 B2
(45) Date of Patent: May 2, 2006

(54) DRIVE DEVICE OF THE BULL-WHEEL OF A SINGLE CARRYING-HAULING ROPE CHAIR LIFT WITH FIXED ROPE GRIPS

(75) Inventors: Yannick Morand, Grenoble (FR); Franckie Tamisier, Saint Nazaire les Eymes (FR)

(73) Assignee: Pomagalski S.A., Fontaine (FR)

( * ) Notice: Subject to any disclaimer, the term of this patent is extended or adjusted under 35 U.S.C. 154(b) by 146 days.

(21) Appl. No.: 10/628,399

(22) Filed: Jul. 29, 2003

(65) Prior Publication Data

US 2005/0051049 A1 Mar. 10, 2005

(30) Foreign Application Priority Data

Sep. 4, 2002 (FR) ..... 02 10924

(51) Int. Cl.
*B61B 12/00* (2006.01)

(52) U.S. Cl. ..... 104/178; 104/197; 104/173.1; 104/196

(58) Field of Classification Search ..... 104/173.2, 104/180, 197, 178, 179, 173.1, 196, 117; 74/89.33, 63
See application file for complete search history.

(56) References Cited

U.S. PATENT DOCUMENTS

| | | | | |
|---|---|---|---|---|
| 2,285,636 | A * | 6/1942 | Wallace | 104/173.2 |
| 4,003,314 | A * | 1/1977 | Pearson | 104/307 |
| 4,049,999 | A * | 9/1977 | Thibaudon | 388/816 |
| 4,100,822 | A * | 7/1978 | Rosman | 104/25 |
| 4,782,761 | A * | 11/1988 | Asberg | 104/196 |
| 4,802,416 | A * | 2/1989 | Meinl | 104/192 |
| 5,134,571 | A * | 7/1992 | Falque et al. | 700/228 |

FOREIGN PATENT DOCUMENTS

| | | |
|---|---|---|
| AT | 388 345 B | 6/1989 |
| CH | 590 147 A | 7/1977 |
| EP | 0 454 596 A | 10/1991 |
| FR | 2 255 200 A | 7/1975 |

* cited by examiner

*Primary Examiner*—Mark T. Le
(74) *Attorney, Agent, or Firm*—Oliff & Berridge, PLC

(57) ABSTRACT

A bull-wheel of a fixed carrying-hauling rope chair lift is driven by a geared motor mechanism having a coaxial shaft line extending perpendicularly to the bull-wheel in a substantially vertical direction. The geared motor mechanism is composed of an electric motor and a mechanical speed reducer forming two independent modules arranged on opposing sides of the bull-wheel, which is fitted on a movable carriage to provide mechanical tensioning of the rope.

16 Claims, 4 Drawing Sheets

DRIVE DEVICE OF THE BULL-WHEEL OF A SINGLE CARRYING-HAULING ROPE CHAIR LIFT WITH FIXED ROPE GRIPS

BACKGROUND OF THE INVENTION

The invention relates to a transport chair lift with a single overhead carrying-hauling rope and fixed grips for securing the chairs, comprising a bull-wheel on which the rope runs, and means for positioning the vertical-axis bull-wheel on a carriage mounted in the terminal on a support device for use as a drive wheel driven by a geared motor mechanism and/or as a tensioning wheel.

STATE OF THE PRIOR ART

The vertical-axis drive wheel of a fixed single carrying-hauling rope chair lift is conventionally rotatably driven by a ring and pinion transmission system enabling rotational movement originating from a geared motor arranged horizontally on a raised platform of the terminal to be transmitted at right angles. Implementation of such a kinematic transmission system is complicated and occupies a large longitudinal space in the terminal. The diversity of the sub-assemblies and the equipment assembly and adjustment time increase the number of operating personnel required and the cost of these known installations.

OBJECT OF THE INVENTION

The object of the invention is to achieve a fixed single carrying-hauling rope chair lift of simplified structure and reduced longitudinal space occupation, using a maximum number of standard mechanical components depending on the type of terminals to be equipped, and regardless of whether a bull-wheel or a tensioning pulley is used.

According to the invention, this object is achieved by the fact that the geared motor mechanism comprises a coaxial shaft line extending perpendicularly to the bull-wheel in a substantially vertical direction.

According to a preferred embodiment, the geared motor mechanism is composed of an electric motor and a mechanical speed reducer constituting two independent modules arranged on each side of the bull-wheel. The first high-speed output shaft of the motor passes through a tubular sheath securedly attached to the carriage, and is coaxially surrounded by the second hollow low-speed output shaft of the speed reducer.

Modular assembly of the geared motor mechanism in a shaft line enables a short kinematic system to be obtained without requiring intermediate transmission means of the ring and pinion type. Such a direct drive system results in a reduction of the assembly time and of the longitudinal space occupation of the terminal.

Other features can be used either singly or in combination:

- the hub of the bull-wheel rotates around the sheath with interposed bearings and comprises a drive sleeve connected to the second rotary shaft of the speed reducer;
- the mechanical speed reducer with gearing-down cogwheels is situated above the bull-wheel and opposite from the electric motor with respect to the vertical direction;
- the geared motor mechanism comprises a motor equipped with an electronic speed control for direct drive of the bull-wheel;

- the bull-wheel is equipped with a toothed wheel designed to cooperate with an emergency motor securedly attached to the carriage;
- the support device comprises a base supporting fixed horizontal sections along which the carriage moves by means of roller means;
- the support carriage of the bull-wheel is associated with a tensioning device acting in the direction of the line to mechanically tension the rope.

According to an alternative embodiment without a geared motor mechanism, the motor can be equipped with an electronic speed control for direct drive of the vertical-axis bull-wheel.

BRIEF DESCRIPTION OF THE DRAWINGS

Other advantages and features will become more clearly apparent from the following description of a particular embodiment of the invention, given as a non-restrictive example only and represented in the accompanying drawings in which.

DESCRIPTION OF A PREFERRED EMBODIMENT

Figure 1:
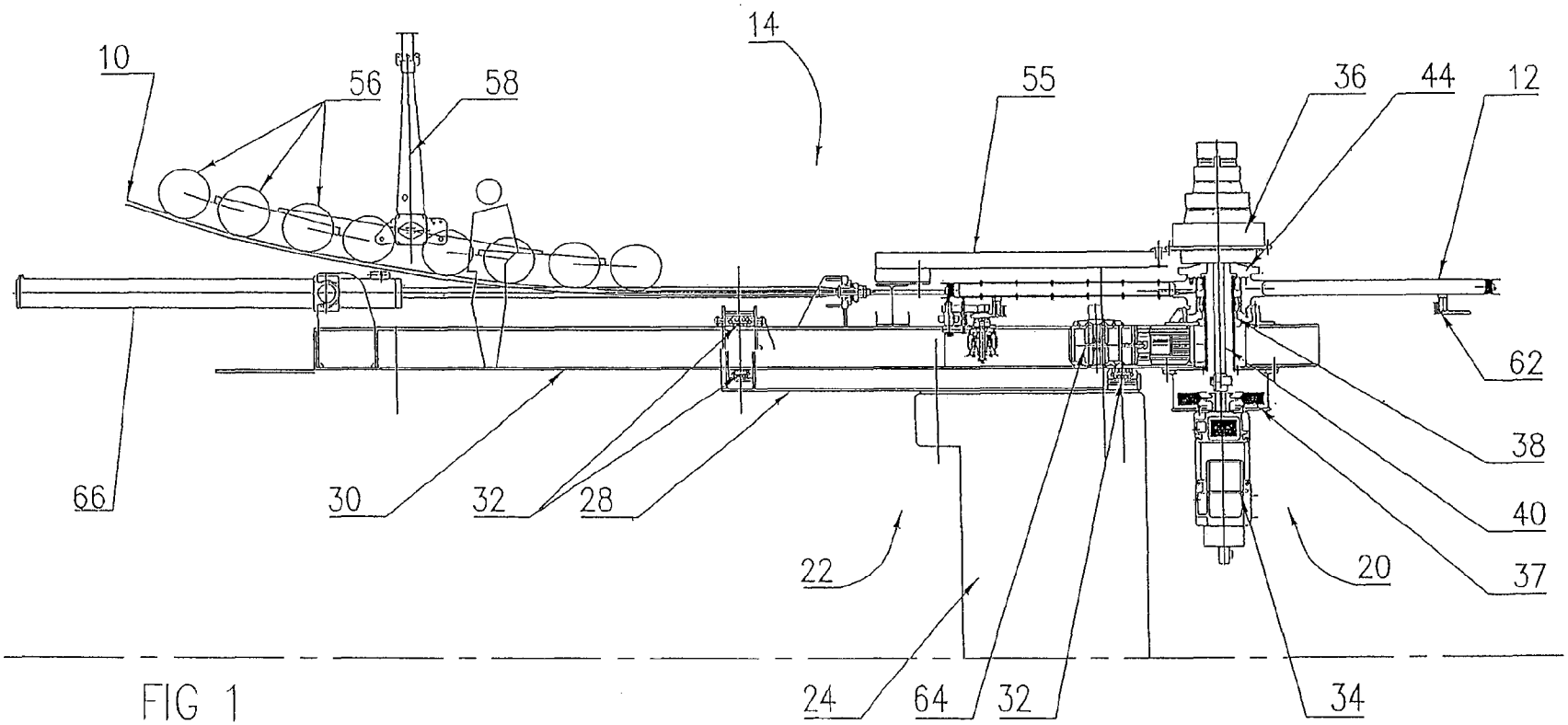
FIG. 1 is a schematic elevational view of the axial drive mechanism of the bull-wheel of a fixed chair lift terminal according to the invention.
Figure 2:
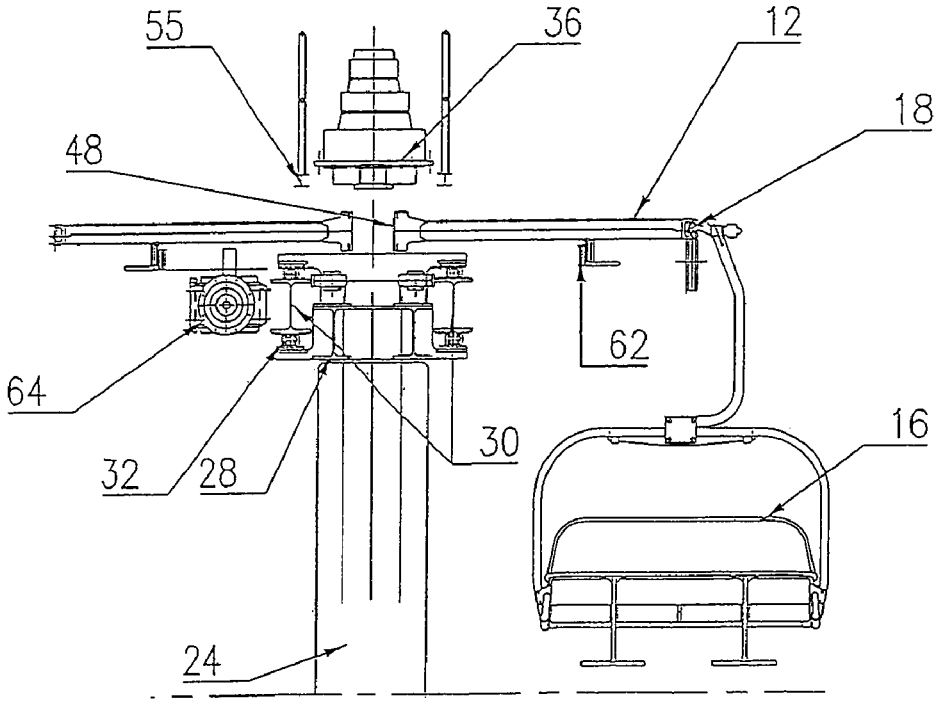
FIG. 2 is a side view of FIG. 1, the electric motor not being represented.
Figure 3:
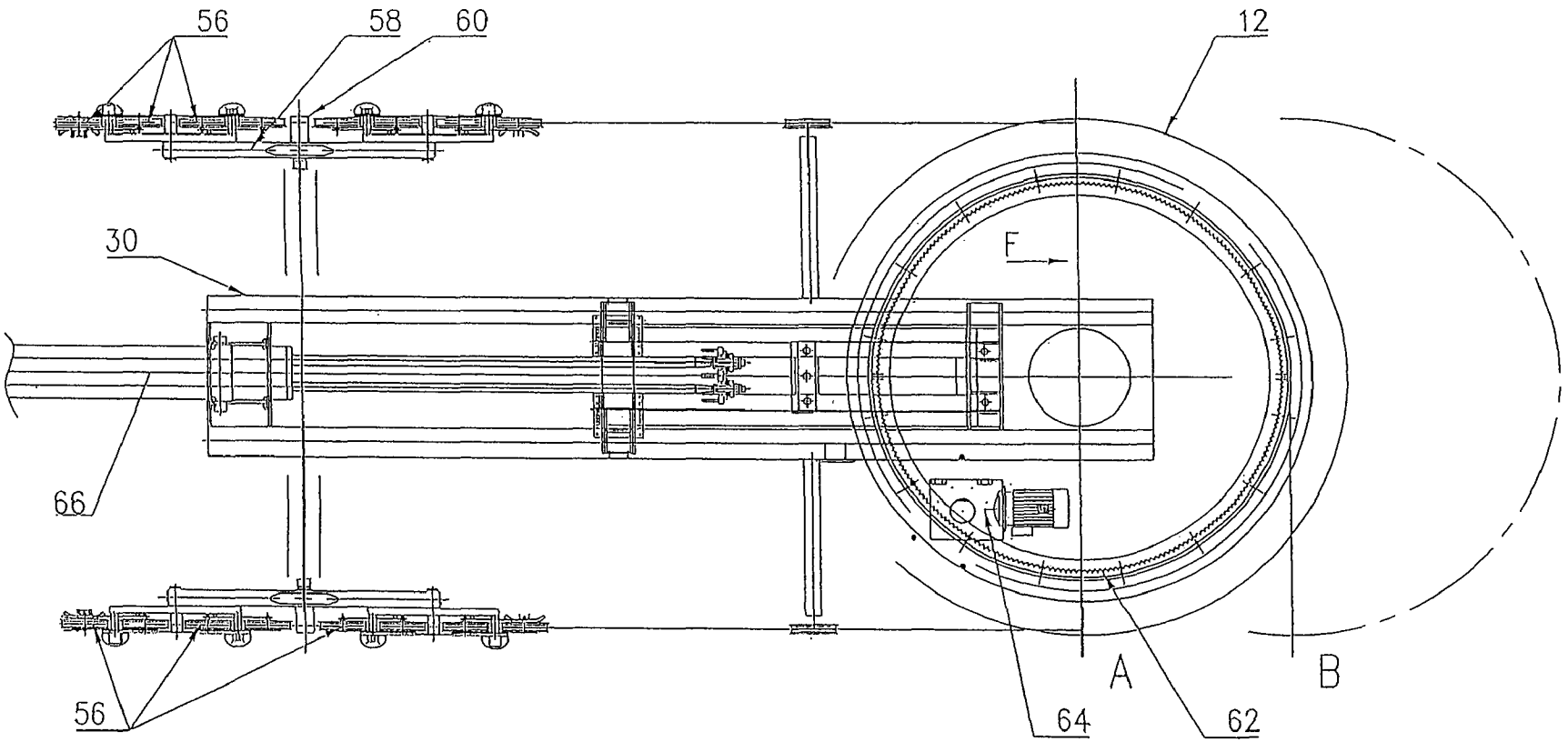
FIG. 3 shows a plan view of FIG. 1, the position B of the bull-wheel in a broken line corresponding to the maximum travel of the movable carriage.
Figure 4:
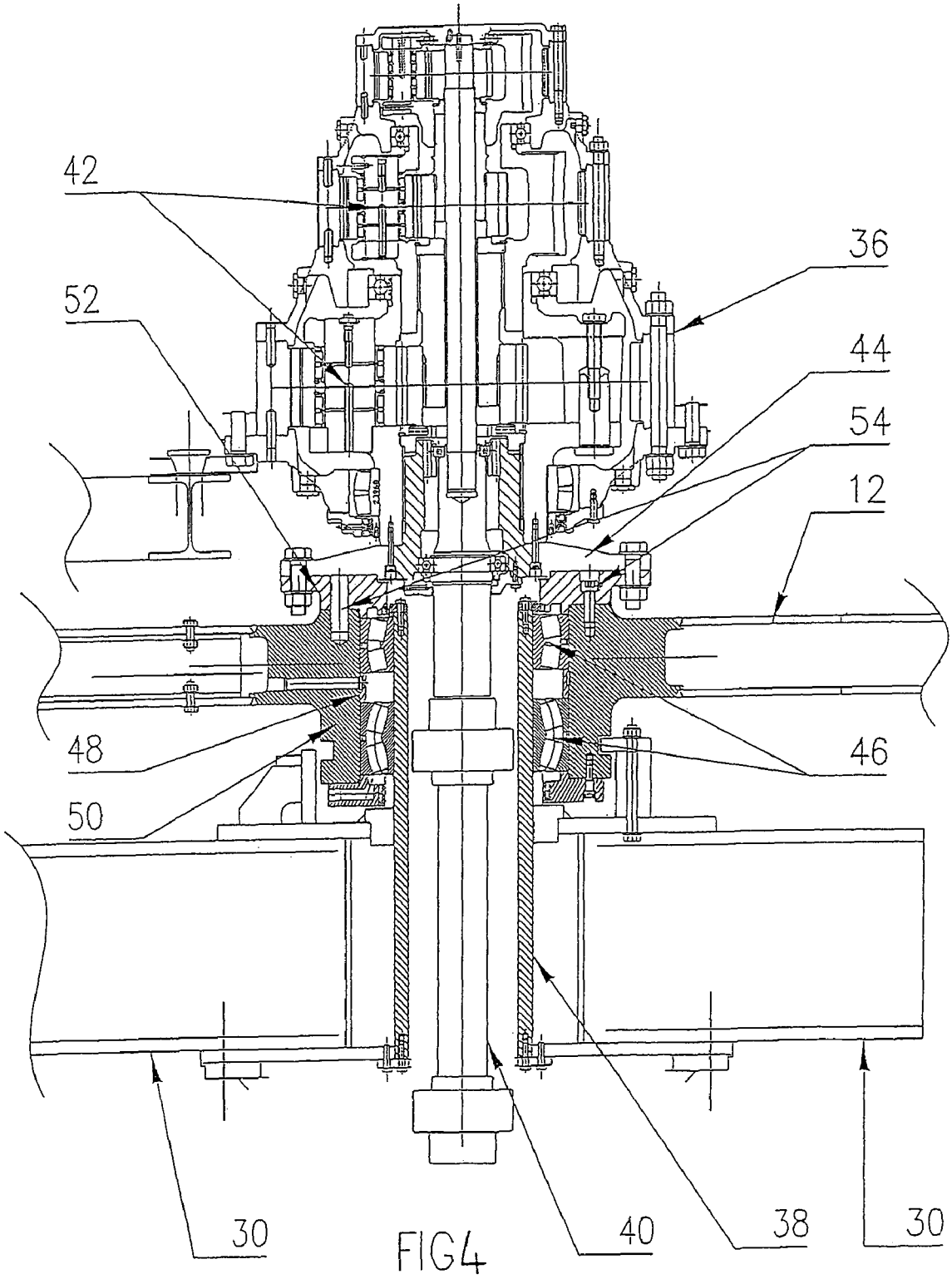
FIG. 4 represents an enlarged scale sectional view of the coupling link of the mechanical speed reducer with the bull-wheel.

In FIGS. 1 to 4, an overhead carrying-hauling rope 10 of a chair runs round a vertical-axis bull-wheel 12 housed in an end station or terminal 14. The rope 10 extends in an endless loop along an up-line and a down-line, and chairs 16, one of which is represented in FIG. 2, are hooked onto the rope 10 at regular intervals by fixed securing grips 18.

The terminal 14 illustrated in FIG. 1 is a down-hill drive terminal wherein the horizontal bull-wheel 12 is driven in rotation by a geared motor mechanism 20 extending perpendicularly to the bull-wheel 12, the assembly being supported by a support device 22 with a predetermined stagger in the heightwise direction.

The support device 22 is composed of a fixed concrete base 24 anchored to the ground, and a horizontal metal frame 26 comprising fixed l-shaped sections 28, and a carriage 30 mounted with horizontal translation by means of roller parts 32.

The bull-wheel 12 and geared motor mechanism 20 are fitted on one of the ends of the carriage 30. The longitudinal travel of the carriage 30 extends over a length of about 3 meters between the positions A and B of FIG. 3, to ensure that the rope 10 is kept taut. A tensioning device, formed for example by a jack 66 or a counterweight, is associated with the carriage so as to act in the direction of the line.

The geared motor mechanism 20 comprises an electric motor 34 arranged under the bull-wheel 12 and a speed reducer 36 arranged above the bull-wheel 12 and in axial alignment with the motor 34. The vertical output shaft of the motor 34 is equipped with an inertia flywheel 37 and passes through a tubular sheath securedly attached to the carriage 30 so as to constitute the high-speed shaft 40 coupled to the input of the speed reducer 36.

The speed reducer 36 is equipped with several stages of gearing-down cog-wheels 42 and a low-speed output shaft 44 for driving the bull-wheel 12 in rotation. A pair of bearings 46 is inserted coaxially between the fixed sheath 38 and a cylindrical bore 48 of the hub 50 of the bull-wheel 12. The output shaft 44 of the speed reducer 36 is hollow and is coupled directly to a drive sleeve fixed to the hub 50 by assembly screws and pins 54. The housing of the speed reducer 36 is supported by a pair of torque arms 55.

The two shafts 40, 44 are coaxial extending perpendicularly with respect to the bull-wheel 12. Modular assembly of the geared motor mechanism 20 in a shaft line enables a short kinematic system to be obtained without requiring intermediate transmission means of the ring and pinion type. The drive structure according to the invention enables a reduction to be made in the assembly time and also in the longitudinal space occupation of the terminal 14.

A roller assembly 56 is mounted on an articulated rocker arm 58 at the entry to the terminal 14 around a transverse axis 60 so as to divert the rope 10 downwards in the direction of the bull-wheel 12.

An emergency toothed wheel 62 is rigidly fixed to the bottom face of the bull-wheel 12 to cooperate with an emergency motor 64 securedly attached to the carriage 30. The emergency motor 64 can be an electric geared motor driven by an electricity generating set, or a hydraulic motor. The bull-wheel 12 can thus be driven in rotation by the emergency motor 64 in case of a maintenance operation on the geared motor mechanism 20.

Fitting of the bull-wheel 12 on the movable carriage 30 and the use of standard items to constitute the geared motor mechanism 20 enable modularity of chair lift terminal sub-assemblies to be achieved.

In the case of a down-hill station 14 according to FIG. 1, the bull-wheel 12 is a drive pulley driven in rotation by the geared motor mechanism 20. Movement of the carriage 30 to the right (arrow F, FIG. 3) between the positions A and B in addition enables tensioning of the rope 10 to be ensured.

The bull-wheel 12 can also be transformed into a simple tensioning pulley, for example for the up-hill station of the chair lift. In this case, the electric motor 34 and speed reducer 36 are not fitted. The coupling link of the speed reducer 36 and electric motor 34 with the bull-wheel 12 simply has to be eliminated. By sliding under the action of the jack 66 of the tensioning device acting in the direction of the line, the carriage 30 holds the rope 10 continuously under a constant strain.

According to an alternative embodiment without a geared motor mechanism, the motor can be equipped with an electronic speed control for direct drive of the vertical-axis bull-wheel.

The invention claimed is:

1. A transport chair lift comprising:

a single overhead carrying-hauling rope;

fixed grips securing chairs to the rope; and a terminal comprising:

a bull-wheel on which the rope runs, the bull-wheel having a substantially horizontal orientation;

a geared motor comprising an electric motor and speed reducer having a coaxial shaft line extending perpendicularly to the bull-wheel in a substantially vertical orientation, the speed reducer being a mechanical speed reducer and the electric motor and the mechanical speed reducer constituting independent modules arranged on opposing sides of the bull-wheel;

a support;

a carriage mounted for movement on the support; and positioning means that positions the carriage and bull-wheel for use as a drive wheel driven by the geared motor and/or as a tensioning wheel.

2. The chair lift according to claim 1, wherein the electric motor is coupled to a first high-speed output shaft that passes through a tubular sheath securely attached to the carriage, and that is coaxially surrounded by a second hollow low-speed output shaft of the geared motor mechanism.

3. The chair lift according to claim 2, wherein the bull-wheel has a hub that rotates around the sheath with interposed bearings, and comprises a drive sleeve connected to the second rotary shaft of the speed reducer.

4. The chair lift according to claim 1, wherein the mechanical speed reducer includes gearing-down cog-wheels, and is positioned above the bull-wheel opposite the electric motor in the vertical direction.

5. The chair lift according to claim 1, wherein the electric motor includes electronic speed control for direct drive of the bull-wheel.

6. The chair lift according to claim 1, wherein the bull-wheel further includes a toothed wheel, and the terminal further includes an emergency motor securely attached to the carriage, for driving the toothed wheel.

7. The chair lift according to claim 1, wherein the support comprises a base supporting fixed horizontal sections along which the carriage moves on rollers.

8. The chair lift according to claim 7, the terminal further comprising a tensioning device that biases the carriage to move in a direction of a line to mechanically tension the rope.

9. A terminal of a transport chair lift including a single overhead carrying-hauling rope and fixed grips securing chairs to the rope, said terminal comprising:

a bull-wheel on which the rope runs, the bull-wheel having a substantially horizontal orientation;

a geared motor comprising an electric motor and speed reducer having a coaxial shaft line extending perpendicularly to the bull-wheel in a substantially vertical orientation, the speed reducer being a mechanical speed reducer and the electric motor and the mechanical speed reducer constituting independent modules arranged on opposing sides of the bull-wheel;

a support;

a carriage mounted for movement on the support; and positioning means that positions the carriage and bull-wheel for use as a drive wheel driven by the geared motor and/or as a tensioning wheel.

10. The terminal according to claim 9, wherein the electric motor is coupled to a first high-speed output shaft that passes through a tubular sheath securely attached to the carriage, and that is coaxially surrounded by a second hollow low-speed output shaft of the geared motor mechanism.

11. The terminal according to claim 10, wherein the bull-wheel has a hub that rotates around the sheath with interposed bearings, and comprises a drive sleeve connected to the second rotary shaft of the speed reducer.

12. The terminal according to claim 9, wherein the mechanical speed reducer includes gearing-down cogwheels, and is positioned above the bull-wheel opposite the electric motor in the vertical direction.

13. The terminal according to claim 9, wherein the electric motor includes electronic speed control for direct drive of the bull-wheel.

14. The terminal according to claim 9, wherein the bull-wheel further includes a toothed wheel, and the terminal further includes an emergency motor securely attached to the carriage, for driving the toothed wheel.

15. The terminal according to claim 9, wherein the support comprises a base supporting fixed horizontal sections along which the carriage moves on rollers.

16. The terminal according to claim 15, the terminal further comprising a tensioning device that biases the carriage to move in a direction of a line to mechanically tension the rope.

* * * * *